US008305169B2

(12) United States Patent
Suzuki et al.

(10) Patent No.: US 8,305,169 B2
(45) Date of Patent: Nov. 6, 2012

(54) ELECTROMAGNETIC SWITCH WITH ENHANCED STABILITY IN OPERATION

(75) Inventors: Yoshiaki Suzuki, Kariya (JP); Mitsuhiro Murata, Niwa-gun (JP)

(73) Assignee: Denso Corporation, Kariya (JP)

( * ) Notice: Subject to any disclaimer, the term of this patent is extended or adjusted under 35 U.S.C. 154(b) by 62 days.

(21) Appl. No.: 12/963,037

(22) Filed: Dec. 8, 2010

(65) Prior Publication Data

US 2011/0140813 A1 Jun. 16, 2011

(30) Foreign Application Priority Data

Dec. 11, 2009 (JP) ..... 2009-281477
Nov. 11, 2010 (JP) ..... 2010-253157

(51) Int. Cl.
*H01H 67/02* (2006.01)

(52) U.S. Cl. ..... 335/126; 335/131

(58) Field of Classification Search ..... 335/78, 335/126, 131
See application file for complete search history.

(56) References Cited

U.S. PATENT DOCUMENTS

| | | | | |
|---|---|---|---|---|
| 4,674,344 | A * | 6/1987 | Kazino et al. | 74/7 A |
| 5,103,107 | A | 4/1992 | Yamamoto et al. | |
| 5,159,908 | A | 11/1992 | Eyermann et al. | |
| 5,656,981 | A * | 8/1997 | Niimi et al. | 335/126 |
| 6,822,544 | B2 * | 11/2004 | Shiga et al. | 335/126 |
| 6,923,152 | B2 * | 8/2005 | Nagai et al. | 123/179.25 |
| 7,034,643 | B1 * | 4/2006 | Kusumoto et al. | 335/126 |
| 7,038,564 | B1 * | 5/2006 | Kusumoto et al. | 335/126 |
| 7,915,984 | B2 * | 3/2011 | Niimi | 335/126 |
| 2004/0032309 | A1 | 2/2004 | Kajino et al. | |
| 2005/0093665 | A1 | 5/2005 | Imanishi et al. | |
| 2009/0206965 | A1 | 8/2009 | Niimi | |
| 2010/0033276 | A1 | 2/2010 | Niimi et al. | |

FOREIGN PATENT DOCUMENTS

| | | |
|---|---|---|
| EP | 2 093 786 A1 | 8/2009 |
| JP | A-2009-032591 | 2/2009 |
| JP | A-2009-068426 | 4/2009 |
| JP | A-2009-224315 | 10/2009 |
| JP | A-2010-040418 | 2/2010 |

OTHER PUBLICATIONS

Sep. 22, 2011 Search Report issued in European Patent Application No. 10015535.7.

* cited by examiner

*Primary Examiner* — Elvin G Enad
*Assistant Examiner* — Alexander Talpalatski
(74) *Attorney, Agent, or Firm* — Oliff & Berridge PLC.

(57) ABSTRACT

A normally-closed electromagnetic relay which may be used in controlling a supply of electric current to an automotive engine starter. The electromagnetic relay is equipped with a resistor and a shirt circuit. The short circuit is created by closing of relay contacts when a relay coil is energized to establish an electric connection between ends of the resistor to supply the current from a battery to an electric motor without flowing through the resistor and opened by opening of the relay contacts when the relay coil is deenergized to supply the electric current from the battery to the electric motor through the resistor. If a motor drive signal line leading to the electromagnetic relay is disconnected when the relay coil is kept energized, it will cause the short circuit to be established to ensure the supply of current to the motor, which also avoids the melting down of the resistor.

21 Claims, 9 Drawing Sheets

STARTER RELAY
ON
OFF
OFF

EXCITING COIL
ON
OFF
OFF

MAIN CONTACT
ON
OFF
OFF

RELAY COIL
ON
OFF
OFF

RELAY CONTACT
ON
OFF
ON

BATTERY VOLTAGE

STARTER CURRENT
t1
t2
TIME

ELECTROMAGNETIC SWITCH WITH ENHANCED STABILITY IN OPERATION

CROSS REFERENCE TO RELATED DOCUMENT

The present application claims the benefits of Japanese Patent Application No. 2009-281477 filed on Dec. 11, 2009 and No. 2010-253157 filed on Nov. 11, 2010, the disclosures of which are incorporated herein by reference.

BACKGROUND

1. Technical Field

The present invention relates generally to an electromagnetic relay which may be installed in a motor circuit of san engine starter and equipped with a built-in resistor which controls a starting current in an electric motor when starting, for example, an internal combustion engine and supplies the current to the electric motor at a full voltage bypassing the resistor after the internal combustion engine is started up.

2. Background Art

Typical engine starters for use in starting an internal combustion engine mounted in, for example, an automotive vehicle are equipped with an electromagnetic switch which works to push a pinion to a ring gear of the engine and to close main contacts in a motor circuit to supply electric current from a storage battery to an electric motor installed in the engine starter.

When the electric motor is turned on, in other words, the electromagnetic switch closes the main contacts, it will cause an excessively large current called the inrush current to flow from the battery to the electric motor, so that the terminal voltage of the battery will drop greatly, which may result in an instantaneous failure in operation of electrical equipment such as indicators or an audio system installed in the vehicle which will also be referred to as a short break.

Japanese Patent First Publication No. 2009-224315, assigned to the same assignee as that of this application, discloses techniques to control the inrush current induced immediately following turning on of the electric motor. Specifically, the disclosed system is equipped with an electromagnetic relay separate from the electromagnetic switch installed in the engine starter. The electromagnetic relay works to open or close the motor circuit selectively and has installed therein a resistor connected electrically to the motor circuit and relay contacts disposed in parallel between an upstream end and a downstream end of the resistor. The electromagnetic relay is of a normally open type in which when a motor drive signal is in an off-state, that is, a relay coil is deenergized, the relay contacts are opened, while when the motor drive signal is in an on-state, that is, the relay coil is energized, the relay contacts are closed.

When it is required to start the engine, the electromagnetic switch installed in the starter closes the main contacts in the condition where the motor drive signal outputted to the electromagnetic relay is in the off-state, so that the relay contacts are opened. This causes the starting current, as controlled by the resistor, to be supplied to the electric motor, so that the electric motor starts to rotate at a low speed. After the pinion is brought into engagement with the ring gear of the engine, the motor drive signal is switched to the on-state, so that the relay contacts are closed to short-circuit the ends of the resistor, thereby supplying the power to the motor at a full voltage of the battery to rotate the motor at a high speed.

The electromagnetic relay is, as described above, of a normally open type which keeps the relay contacts opened when the motor drive signal is in the off-state. Therefore, if a vehicle system fails in operation due to breakage of a motor drive signal line or poor insertion thereof into an electrical connector, it will keep the relay contacts opened. The electromagnetic relay is, therefore, not energized in response to the motor drive signal outputted from an electronic control unit (ECU), so that the relay contacts are kept opened. This causes the current, as supplied from the battery, to flow to the electric motor through the resistor at all the time. For instance, in a cold condition where the outside temperature is low, a load on the electric motor is usually increased with an increase in mechanical friction of the engine, and a resistance value of the motor circuit is decreased, so that more current flows through the resistor.

Further, even when the electric motor is turned on, and the pinion engages the ring gear, the relay contacts are not closed, so that the voltage is not applied to the electric motor fully, thus resulting in a difficulty in starting the engine, that is, lowered start-up performance of the engine. The continuous flow of current to the electric motor through the resistor may cause the resistor to be melted down, which leads to impossibility to start the engine.

SUMMARY

It is therefore a principal object of the invention to avoid the disadvantages of the prior art.

It is another object of the invention to provide an improved structure of an electromagnetic relay designed to ensure the stability in supplying electric current to an electric motor if a motor drive signal line is broken, so that a motor drive signal is not sent to the electromagnetic relay.

According to one aspect of the invention, there is provided an electromagnetic relay which may be installed in a starter for internal combustion engines of automotive vehicles. The electromagnetic relay is of a normally closed type and comprises: (a) a hollow case which has an end extending substantially perpendicular to an axial direction thereof to define a bottom, the bottom having a radially central portion extending outwardly of the hollow case in the axial direction to define a hollow protrusion; (b) a resistor to be connected electrically at ends thereof to a motor circuit to control a starting current supplied from a battery to an electric motor when it is required to start the electric motor; (c) a relay coil disposed inside the hollow case, the relay coil producing magnetic attraction when energized; (d) a movable core having a first and a second end opposed to each other in an axial direction thereof in which the movable core is to be moved by the magnetic attraction, as produced by the relay coil, along an inner periphery of the relay coil with the first end being disposed inside the hollow protrusion of the case; (e) relay contacts which are to be opened or closed selectively by movement of the movable core when the relay coil is energized or deenergized; and (f) a short circuit which is created by closing of the relay contacts when the relay coil is energized to establish an electric connection between the ends of the resistor to supply an electric current from the battery to the electric motor without flowing through the resistor and opened by opening of the relay contacts when the relay coil is deenergized to supply the electric current from the battery to the electric motor through the resistor.

The relay contacts are, as described above, opened when relay coil is energized. Therefore, if a vehicle system has failed in is operation due to, for example, disconnection or breakage of a motor drive signal line through which a motor drive signal is sent to the electromagnetic relay or poor insertion of the motor drive signal line into an electrical connector when the relay contacts are kept opened, it will cause the motor drive signal to be cut, so that the relay coil is deenergized, and the relay contacts are closed undesirably. When the relay contacts are closed, the short circuit is established to supply the electric current from the battery to the electric motor without flowing through the resistor. This prevents the current from continuing to flow through the resistor even if the motor drive signal to the motor relay is cut off, thus avoiding the melting down of the resistor. Further, when the relay contacts are closed, a full voltage of the battery is permitted to be supplied to the motor, thus ensuring the stability in operation of the motor.

The bottom of the hollow case has the hollow protrusion which extends outwardly and axially of the hollow case. The movable core is to be moved inside the relay coil in the axial direction thereof with the first end placed inside the hollow protrusion. This structure permits the relay coil to be disposed close to an inner surface of the bottom of the hollow case to use the bottom as a portion of a magnetic circuit. This eliminates the need for arranging an additional part such as a magnetic plate near the end of the relay coil, thus minimizing the number of parts and decreasing the number of assembling processes of the electromagnetic relay.

In the preferred mode of the invention, the electromagnetic relay also includes a stationary core disposed adjacent the second end of the movable core. The stationary core is magnetized when the relay coil is energized to produce the magnetic attraction to attract the movable core. A length of a portion of the movable core which is disposed inside the hollow protrusion is set greater than an interval kept between the movable core and the stationary core when the relay coil is deenergized. Specifically, when the relay coil is energized electrically to magnetize the stationary core, so that the movable core to be attracted to the stationary core, the first end of the movable core is kept disposed inside the hollow protrusion, in other words, does not get out of the hollow protrusion, thus keeping the air gap between the bottom of the hollow case and the movable core to the minimum. Therefore the air gap is kept unchanged from when the movable contact starts to be moved until it arrives at the stationary core, thus keeping a magnetic resistance unchanged for a period of time the movable core travels to the stationary core to ensure a required magnitude of the magnetic attraction, as produced by the stationary core.

The electromagnetic relay also includes a hollow resinous bobbin around of which the relay coil is wound and a thin-wall hollow cylinder formed integrally with the bobbin. The thin-wall hollow cylinder is disposed between a portion of an outer periphery of the movable core disposed inside the hollow protrusion and an inner periphery of the hollow protrusion. The thin-wall hollow cylinder has substantially the same inner diameter as the hollow protrusion to have a common cylindrical inner wall extending without any irregularities to define the outer periphery of the movable core and the inner periphery of the hollow protrusion.

Specifically, the thin-wall hollow cylinder is formed integrally with the resinous bobbin, in other words, made if resin. The thin-wall hollow cylinder lies between the portion of the movable core disposed inside the hollow protrusion and the hollow protrusion, so that the movable core does not slide directly on the inner periphery of the hollow protrusion, thus avoiding the mechanical wear thereof.

The thin-wall hollow cylinder is formed integrally with the bobbin to have the cylindrical inner even surface which extends over the inner periphery of the bobbin without any irregularities, thus ensuring the smooth movement of the movable core in the axial direction thereof without the axis thereof being inclined greatly.

The hollow case has a main body with a bottom which is formed to be separate from the hollow protrusion. The hollow protrusion may be designed to be joined detachably to the bottom of the main body of the hollow case. This structure enables the hollow protrusion to be removed from the hollow case to take the movable core and its related components out of the hollow case for replacement.

The electromagnetic relay may also include a non-magnetic spacer disposed between an inner bottom surface of the hollow protrusion and the movable core. This structure keeps the end surface of the movable core out of direct contact with the bottom of the hollow protrusion and results in an increase in magnetic resistance between the bottom of the hollow protrusion and the movable core, thereby improving the efficiency in producing the magnetic attraction acting on the movable core when the relay coil is energized and ensuring the stability in operation of the movable core.

The electromagnetic relay also includes a bracket for use in mounting the electromagnetic relay in a vehicle. The bracket is disposed outside the hollow protrusion and fixed on the bottom of the hollow case. The bracket has a thickness in an axial direction of the electromagnetic relay. The thickness is substantially identical with or greater than a height of the hollow protrusion which projects from the major body of the relay case. This structure permits the whole of the hollow protrusion to be kept inside the bracket. In other words, the hollow protrusion does not project from the thickness of the bracket, thus improving the mountability of the electromagnetic relay in, for example, an engine starter for automotive vehicles.

The hollow case may be formed by the typical drawing process, which usually results in a decreased thickness. The bracket is used for mounting the electromagnetic relay in, for example, the automotive vehicle and thus required to have a mechanical strength great enough to withstand mechanical vibrations arising from an engine of the vehicle or traveling of the vehicle and also to secured firmly to the hollow case through, for example, the welding. The bracket, therefore, needs to be made of a thick-walled plate. This enables the bracket affixed to the bottom of the hollow case to be used as a portion of the magnetic circuit, thereby alleviating an increase in magnetic resistance of the bottom of the hollow case which is made to have a thin wall.

The electromagnetic relay may also include (a) a bulkhead which is located remote from the bottom of the relay case on an opposite side of the relay coil and formed one of integrally with and separately from the stationary core, (b) an insulating cover which closes an opening formed in an end of the hollow case which is opposite the bottom and is secured to the hollow case, (c) a first external terminal which is secured to the insulating cover and connected to a high-potential side of the motor circuit, (d) a second external terminal which is secured to the insulating cover and connected to a low-potential side of the motor circuit, (e) a first fixed contact which is disposed inside the insulating cover and connected electrically and mechanically to the first external terminal, (f) a second fixed contact which is disposed inside the insulating cover and connected electrically and mechanically to the second external terminal, (g) a movable contact which is disposed remote from the bulkhead on an opposite side of the first and second fixed contacts and to be moved following movement of the movable core to establish and block an electric connection between the first and second fixed contacts, selectively, and (h) a shaft which, when the relay coil is energized to move the movable core to the stationary core, transmit movement of the movable core to the movable contact. The resistor is disposed inside the insulating cover and connected at one of the ends thereof to the first external terminal and at the other end to the second external terminal. When the relay coil is energized, the movable contact is moved away from the first and second fixed contacts to open the relay contacts. When the relay coil is deenergized, the movable contact is moved into abutment with the first and second fixed contacts to close the relay contacts.

Specifically, when the relay coil is deenergized, the movable contact is placed in contact with the first and second fixed contacts to close the relay contacts, while when the relay coil is energized to produce the magnetic attraction to attract the movable core to the stationary core, the movement of the movable core will be transmitted to the movable contact through the shaft and then moved away from the first and second fixed contacts to open the relay contacts.

The resistor is disposed inside the cover, thus avoiding adhesion of drop of water into the resistor which have come from outside the cover, which improves the durability of the resistor. Further, the cover protects the resistor against adhesion of combustible objects existing outside the electromagnetic relay, thus ensuring the safety of the electromagnetic relay when the current continues to flow through resistor for a long time, so that the resistor glows.

The space may be formed to have elasticity. This absorbs impact sound arising from hitting of the movable contact against the spacer when the relay coil is switched to the off-state, so that the movable core is returned away from the stationary core.

Surfaces of the first and second fixed contacts and the movable contact which are to be placed in contact with each other have irregularities. In typical normally-closed electromagnetic relays, planes of the movable contact and the fixed contacts may rub on each other when subjected to external mechanical vibrations, which leads to a change in resistance of contact between the planes or chattering of the planes. In order to alleviate such a problem, the contact, surfaces of the first and second fixed contacts and the movable contact have the irregularities.

The bulkhead and the stationary core constitute a magnetic path component which has formed in a radially central portion thereof a hole which extends in an axial direction of the magnetic path component and through which a resinous hollow guide cylinder is disposed. The guide cylinder works to guide movement of the shaft. The shaft is made of an insulating material separate from the movable core and to be moved inside the hollow guide cylinder following the movement of the movable core.

Specifically, the shaft is not disposed directly within the hole of the magnetic path component, but placed to be movable along an inner periphery of the guide cylinder inserted into the hole of the magnetic path component. In other words, when pushed by the movable core, the shaft slides on the inner periphery of the guide cylinder, thus resulting in a great decrease in mechanical wear of the shaft.

The guide cylinder may be made by a discrete cylindrical member or formed by a one-piece member together with the bobbin around which the relay coil is wound. The bulkhead may also be insert-molded with the one-piece member.

The electromagnetic relay also includes a return spring which works to urge the movable core away from the stationary core. The shaft has formed on an end thereof facing the movable core a flange which extends radially outwardly of the shaft. The flange is exerted by pressure, as produced by the return spring, to be brought into constant abutment with the movable core, thus eliminating the need for securing the shaft mechanically to the movable core using, for example, a swaging tool, which minimizes production processes for the electromagnetic relay.

Each of the first and second external terminals is provided by a bolt with an external thread and secured to the cover with the external thread being exposed outside the cover, thus enabling the electromagnetic relay to be connected electrically to electric parts of, for example, an automotive engine starter and the automotive vehicle without having to exchange electric leads or connectors typically used in the vehicle.

The movable core has recesses formed in radially central portions of ends opposed to each other in an axial direction thereof to have an H-shape in longitudinal cross section extending in the axial direction of the movable core, thus resulting in a decrease in weight of the movable core, which ensures a quick movement thereof in response to the attraction to the stationary core. The cylindrical recesses may be symmetrical in shape, thus permitting the movable core to be inserted into the bobbin from either end thereof, which leads to a decrease in error in assembling the electromagnetic relay.

According to the second aspect of the invention, there is provided a normally-closed electromagnetic relay which comprises: (a) a hollow case which has ends opposed to each other in an axial direction of the hollow case, one of the ends defining a bottom, the other end having an opening; (b) a resistor to be connected electrically at ends thereof to a motor circuit to control a starting current supplied from a battery to an electric motor when it is required to start the electric motor; (c) a relay coil disposed inside the hollow case, the relay coil producing magnetic attraction when energized; (d) a movable core which is to be moved by the magnetic attraction, as produced by the relay coil, along an inner periphery of the relay coil; (e) relay contacts which are to be opened or closed selectively by movement of the movable core when the relay coil is energized or deenergized; (f) a short circuit which is created by closing of the relay contacts when the relay coil is energized to establish an electric connection between the ends of the resistor to supply an electric current from the battery to the electric motor without flowing through the resistor and opened by opening of the relay contacts when the relay coil is deenergized to supply the electric current from the battery to the electric motor through the resistor; (g) an annular magnetic plate disposed between the bottom of the relay case and an end of the relay coil to create a magnetic path between the hollow case and the movable core; (h) a bulkhead which is located remote from the magnetic plate on an opposite side of the relay coil to create a magnetic path extending radially thereof; (i) a stationary core which is formed one of integrally with and is separately from the bulkhead and develops a magnetic path continuing to the magnetic path, as created by the bulkhead, the stationary core being so disposed as to face the movable core in an axial direction thereof; (j) an insulating cover which closes the opening of the hollow case and is secured to the hollow case; (k) a first external terminal which is secured to the insulating cover and connected to a high-potential side of the motor circuit; a second external terminal which is secured to the insulating cover and connected to a low-potential side of the motor circuit; (l) a first fixed contact which is disposed inside the insulating cover and connected electrically and mechanically to the first external terminal; (m) a second fixed contact which is disposed inside the insulating cover and connected electrically and mechanically to the second external terminal; (n) a movable contact which is disposed remote from the bulkhead on an opposite side of the first and second fixed contacts and to be moved following movement of the movable core to establish and block an electric connection between the first and second fixed contacts, selectively; (o) a shaft which, when the relay coil is energized to move the movable core to the stationary core, transmit movement of the movable core to the movable contact. The resistor is disposed inside the insulating cover and connected at one of the ends thereof to the first external terminal and at the other end to the second external terminal. When the relay coil is energized, the movable contact is moved away from the first and second fixed contacts to open the relay contacts, while when the relay coil is deenergized, the movable contact is moved into abutment with the first and second fixed contacts to close the relay contacts.

The relay contacts are, as described above, opened when relay coil is energized. Therefore, if a vehicle system has failed in operation due to, for example, disconnection or breakage of a motor drive signal line through which a motor drive signal is sent to the electromagnetic relay or poor insertion of the motor drive signal line into an electrical connector when the relay contacts are kept opened, it will cause the motor drive signal to be cut, so that the relay coil is deenergized, and the relay contacts are closed undesirably. When the relay contacts are closed, the short circuit is established to supply the electric current from the battery to the electric motor without flowing through the resistor. This prevents the current from continuing to flow through the resistor even if the motor drive signal to the motor relay is cut off, thus avoiding the melting down of the resistor. Further, when the relay contacts are closed, a full voltage of the battery is permitted to be supplied to the motor, thus ensuring the stability in operation of the motor.

The resistor is disposed inside the cover, thus avoiding adhesion of drop of water into the resistor which have come from outside the cover, which improves the durability of the resistor. Further, the cover protects the resistor against adhesion of combustible objects existing outside the electromagnetic relay, thus ensuring the safety of the electromagnetic relay when the current continues to flow through resistor for a long time, so that the resistor glows.

The installation of the resistor within the cover avoids a direct contact of the resistor with an inner wall of the cover, thus minimizing thermal damage to the cover due to the heat, as produced by the resistor.

In the preferred mode of the invention, the electromagnetic relay also includes a non-magnetic spacer disposed between the bottom of the hollow case and the movable core. Specifically, when the relay coil is deenergized, the end of the movable core is kept away from the bottom of the hollow case. The installation of the non-magnetic spacer results in an increase in magnetic resistance between the bottom of the hollow case and the movable core, which ensures a required magnitude of magnetic attraction between the stationary core and the movable core.

The space may be formed to have elasticity. This absorbs impact sound arising from hitting of the movable contact against the spacer when the relay coil is switched to the off-state, so that the movable core is returned away from the stationary core.

Surfaces of the first and second fixed contacts and the movable contact which are to be placed in contact with each other have irregularities. In typical normally-closed electromagnetic relays, planes of the movable contact and the fixed contacts may rub on each other when subjected to external mechanical vibrations, which leads to a change in resistance of contact between the planes or chattering of the planes. In order to alleviate such a problem, the contact surfaces of the first and second fixed contacts and the movable contact have the irregularities.

The bulkhead and the stationary core constitute a magnetic path component which has formed in a radially central portion thereof a hole which extends in an axial direction of the magnetic path component and through which a resinous hollow guide cylinder is disposed. The guide cylinder works to guide movement of the shaft. The shaft is made of an insulating material separate from the movable core and to be moved inside the hollow guide cylinder following the movement of the movable core.

Specifically, the shaft is not disposed directly within the hole of the magnetic path component, but placed to be movable along an inner periphery of the guide cylinder inserted into the hole of the magnetic path component. In other words, when pushed by the movable core, the shaft slides on the inner periphery of the guide cylinder, thus resulting in a great decrease in mechanical wear of the shaft.

The guide cylinder may be made by a discrete cylindrical member or formed by a one-piece member together with the bobbin around which the relay coil is wound. The bulkhead may also be insert-molded with the one-piece member.

The electromagnetic relay also includes a return spring which works to urge the movable core away from the stationary core. The shaft has formed on an end thereof facing the movable core a flange which extends radially outwardly of the shaft. The flange is exerted by pressure, as produced by the return spring, to be brought into constant abutment with the movable core, thus eliminating the need for securing the shaft mechanically to the movable core using, for example, a swaging tool, which minimizes production processes for the electromagnetic relay.

Each of the first and second external terminals is provided by a bolt with an external thread and secured to the cover with the external thread being exposed outside the cover, thus enabling the electromagnetic relay to be connected electrically to electric parts of, for example, an automotive engine starter and the automotive vehicle without having to exchange electric leads or connectors typically used in the vehicle.

The movable core has recesses formed in radially central portions of ends opposed to each other in an axial direction thereof to have an H-shape in longitudinal cross section extending in the axial direction of the movable core, thus resulting in a decrease in weight of the movable core, which ensures a quick movement thereof in response to the attraction to the stationary core. The cylindrical recesses may be symmetrical in shape, thus permitting the movable core to be inserted into the bobbin from either end thereof, which leads to a decrease in error in assembling the electromagnetic relay.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 7(*b*) is a partially enlarged view of a portion of the electromagnetic relay of FIG. 7(*a*), as indicated by an arrow A;

FIG. 8(*b*) is a partially enlarged view of a portion of the electromagnetic relay of FIG. 8(*a*), as indicated by an arrow A.

DESCRIPTION OF THE PREFERRED EMBODIMENTS

Figure 1:
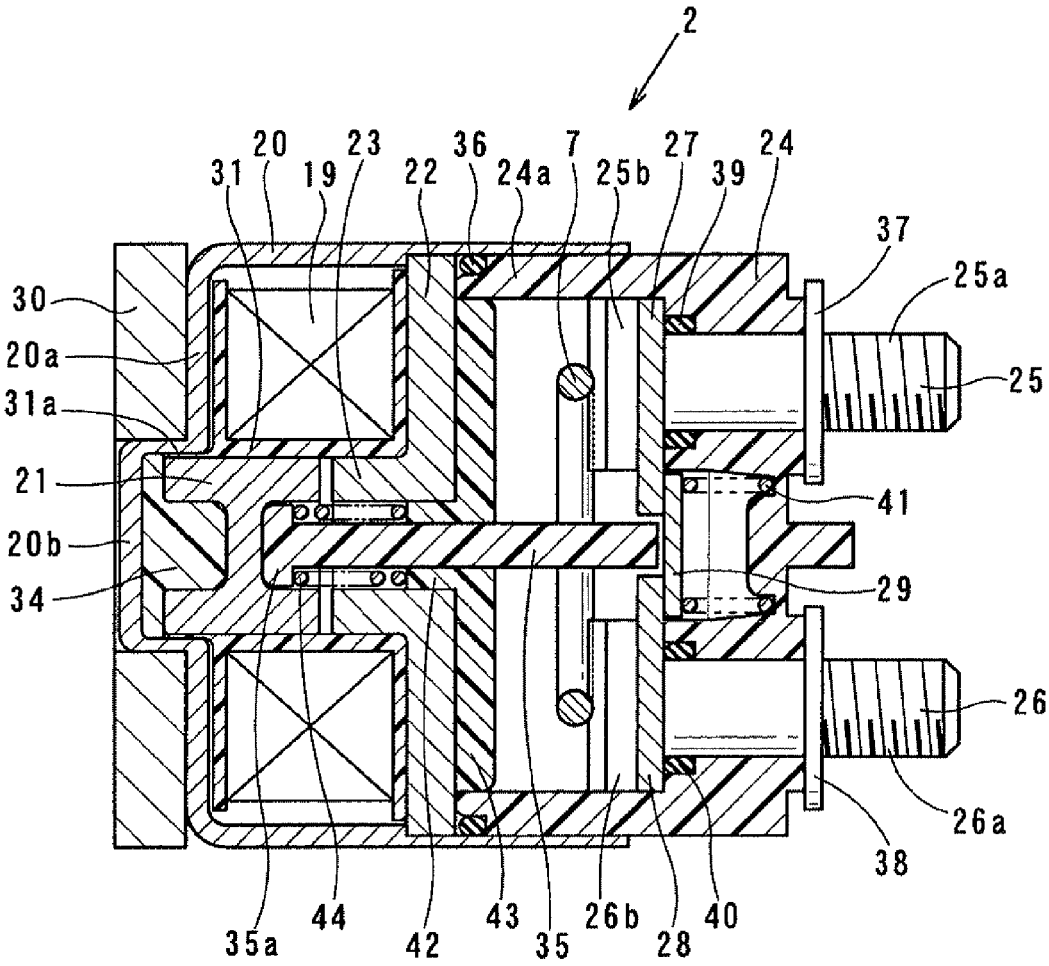
FIG. 1 is a longitudinal sectional view which shows an internal structure of an electromagnetic relay according to the first embodiment of the invention.
Figure 2:
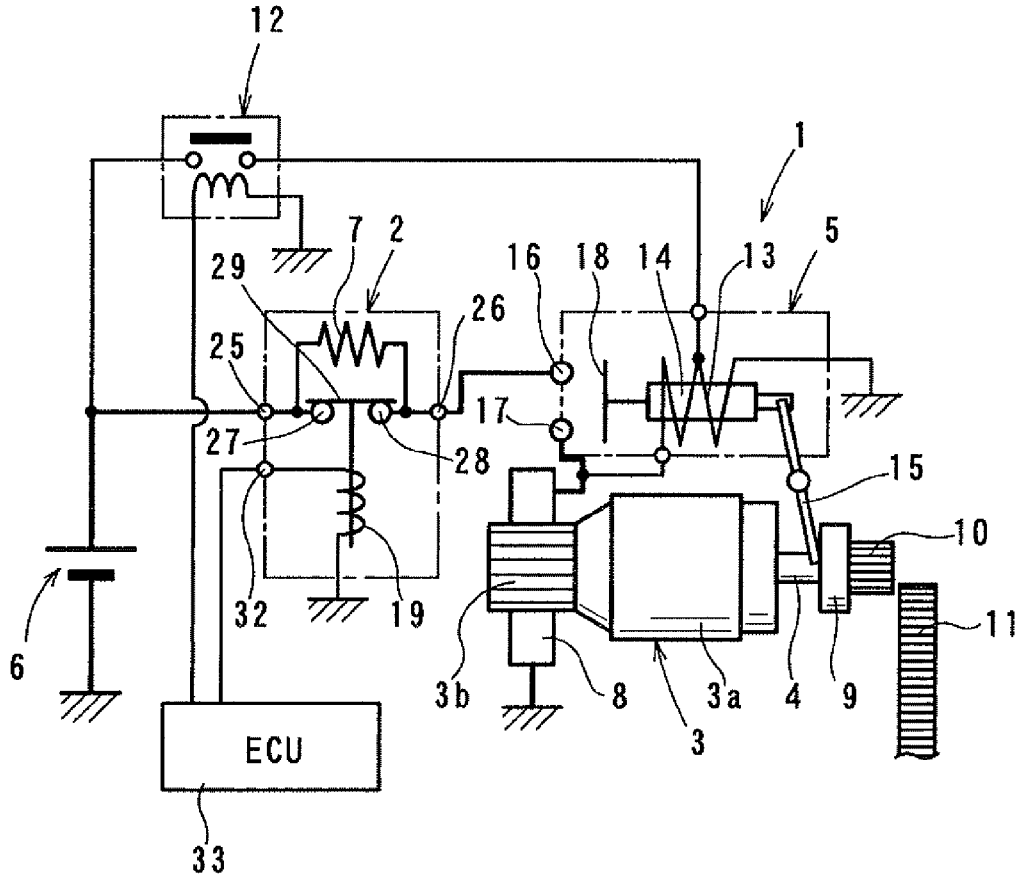
FIG. 2 is a diagram which shows an electric circuit of an automotive engine starter equipped with the electromagnetic relay of FIG. 1 and illustrates for the case where the electromagnetic relay is placed in an off-state.

Referring to the drawings, wherein like reference numbers refer to like parts in several views, particularly to FIGS. 1 and 2, there is shown an electromagnetic relay 2 which is installed in a motor circuit of an engine starter 1 according to the first embodiment of the invention. The engine starter 1 works to start, for example, an internal combustion engine mounted in an automotive vehicle. The electromagnetic relay 2 serves to supply an electric current to an electric motor 3 and will also be referred to as a motor relay below.

The starter 1 is, as clearly illustrated in FIG. 2, equipped with the motor 3, an output shaft 4, a pinion carrier (which will be described later in detail), an electromagnetic switch 5, and the motor relay 2. When energized, the motor 3 produces torque through an armature 3*a* to rotate the output shaft 4. The pinion carrier is movable along the output shaft 4. The electromagnetic switch 5 works to push the pinion carrier away from the motor 3 (i.e., in the leftward direction, as viewed in the drawing) and open or close main contacts (which will be described later in detail) installed in the motor circuit. The motor relay 2 has installed in a resistor 7 which serves to control a starting current flowing from a battery 6 to the motor 3 when the motor 3 is energized. A speed reducer such as a planetary gear set may be disposed between the motor 3 and the output shaft 4 to reduce the speed of the motor 3 to produce amplified torque.

The motor 3 is of a typical commutator type which is equipped with a magnetic field (not shown) formed by permanent magnets or electromagnets, the armature 3*a* with a commutator 3*b*, and brushes 8 riding on the outer periphery of the commutator 3*b*.

The pinion carrier is made up of a clutch 9 and a pinion 10.

The clutch 9 includes an outer meshing with the outer periphery of the output shaft 4 through helical splines, an inner formed integrally with the pinion 10, and rollers disposed between the outer and the inner to establish or block transmission of torque therebetween. The clutch 9 serves as a one-way clutch to transmit the torque only from the outer (i.e., the output shaft 4) to the inner (i.e., the pinion 10) through the rollers.

When it is required to start the engine, the pinion 10 moves along the periphery of the output shaft 4 away from the motor 3 and then engages a ring gear 11 secured to a crankshaft of the engine to transmit the torque, as produced by the motor 3, to the ring gear 11.

The electromagnetic switch 5 includes an exciting coil 13 and a plunger 14. The exciting coil 13 is connected electrically to the battery 6 through a starter relay 12. The plunger 14 is movable inside the exciting coil 13 in an axial direction thereof. Specifically, when energized, the exciting coil 13 will produce magnetic attraction to move the plunger 14 in the axial direction to close the main contacts and also to push the pinion carrier away from the motor 3.

The main contacts are provided by two fixed contacts 16 and 17 connected to the motor circuit through two terminal bolts (not shown) and a movable contact 18 which are to be moved following movement of the plunger 14 in the axial direction thereof. When the movable contact 18 touches the fixed contacts 16 and 17, it makes an electrical connection between the fixed contacts 16 and 17. Conversely, when the movable contact 18 is moved away from the fixed contacts 16 and 17, it blocks the electrical connection between the fixed contacts 16 and 17. The terminal bolts are provided by a so-called B-terminal connected electrically to a high-potential side of the motor circuit (i.e., the battery 6) and a so-called M-terminal connected electrically to the a low-potential side of the motor circuit (i.e., the motor 3).

The structure of the motor relay 2 will be described in detail with reference to FIG. 1.

The motor relay 2 is equipped with a relay coil 19 and relay contacts (which will be described later in detail). When energized electrically, the relay coil 19 works as an electromagnet to close the relay contacts. When the relay contacts are closed, a short-circuit is developed to connect ends of the resistor 7 electrically. When the relay contacts are opened, the short-circuit is opened to permit the current to flow through the resistor 7. FIG. 1 illustrates the status of the motor relay 2 when the relay coil 19 is deenergized.

The motor relay 2 is made up of a relay case 20, the relay coil 19, a movable core 21, a partition wall or bulkhead 22, a stationary core 23, a resinous cover 24, two external terminals 25 and 26, a first and a second fixed contact 27 and 28, a movable contact 29, and the resistor 7. The relay case 20 servers as a portion of a magnetic circuit. The relay coil 19 is disposed within the relay case 20. The movable core 21 is to move inside the inner periphery of the relay coil 19 in the axial direction thereof. The bulkhead 22 is disposed adjacent the relay coil 19. The stationary core 23 is placed in alignment with the movable core 2 in the axial direction of the motor relay 2. The cover 24 is secured to the relay case 20 to close an opening of the relay case 20. The external terminals 25 and 26 are fixed firmly at ends thereof in the cover 24. The first and second fixed contacts 27 and 28 are affixed to the external terminals 25 and 26 and connected electrically to the motor circuit through the external terminals 25 and 26. The movable contact 29 is movable to establish or block electrical connection between the first and second fixed contacts 27 and 28. The resistor 7 is disposed electrically between the external terminals 25 and 26.

The relay case 20 is of a hollow cylindrical shape and has axially-opposed ends one of which is a bottom and the other of which is an opening. The bottom has a bottom wall 20*a* extending substantially perpendicular to the axial direction of the relay case 20 (i.e., the axial direction of the motor relay 2).

The bottom wall 20*a* has a radially central portion extending outwardly thereof in the axial direction of the relay case 20 (i.e., a leftward direction, as viewed in the drawing) to define a hollow protrusion 20*b*. The protrusion 20*b* is of a cylindrical shape and has an inner diameter slightly greater than that of the movable core 21.

The relay case 20 is formed by, for example, the drawing method and has formed on an inner periphery an annular inner shoulder to define a large-diameter chamber and a small-diameter chamber. The large-diameter chamber and the small-diameter chamber are disposed adjacent each other in the axial direction of the relay case 20. The relay coil 19 is disposed inside the small-diameter chamber. The large-diameter chamber is defined by a thinner wall of the relay case 20, while the small-diameter chamber is defined by a thicker wall of the relay case 20. Such a difference in wall thickness corresponds to a width of the inner shoulder.

The relay case 20 has fitted on an outer bottom surface a bracket 30 for mounting the motor relay 2 in the vehicle. For instance, the bracket 30 is used in retaining or fixing the motor relay 2 on a vehicle body (e.g., a housing of the starter 1). The bracket 30 is made of a metallic iron plate with a center hole. The bracket 30 is fit on the circumference of the cylindrical protrusion 20*b* and welded to the bottom wall 20*a* of the relay case 20 firmly.

The wall thickness of the bracket 30 in the lateral direction, as viewed in the drawing, is substantially identical with or greater than the height of the cylindrical protrusion 20*b* (i.e., an axial length of the cylindrical protrusion 20*b* between an outer surface of a major portion of the bottom wall 20*a* and a top end surface of the cylindrical protrusion 20*b*). In other words, the bracket 30 has an outer end surface which lies flush with the top end surface of the cylindrical protrusion 20*b* or slightly outside the top end surface of the cylindrical protrusion 20*b* in the thickness-wise direction thereof.

The relay coil 19 is made of wire wound around a hollow resinous bobbin 31 and connected at an end thereof to a terminal 32, as illustrated in FIG. 2, and at the other end to ground through the relay case 20. The bobbin 31 has formed integrally therewith a thin-wall hollow cylinder 31*a* fit in an inner periphery of the cylindrical protrusion 20*b* of the relay case 20. The hollow cylinder 31*a* is identical in inner diameter with the bobbin 31. In other words, the hollow cylinder 31*a* and the bobbin 31 have a common cylindrical inner peripheral wall continuing in the axial direction thereof without any irregularities.

The terminal 32 has an end extending outside the cover 24 in electrical connection with an electronic control unit (ECU) 33 which controls an operation of the starter 1.

The movable core 21 is disposed in a cylindrical chamber defined by the common inner peripheral wall of the bobbin 31 and the thin-wall cylinder 31*a*. The movable core 21 is to be moved in the axial direction of the common inner peripheral wall with an end portion thereof disposed inside the cylindrical protrusion 20*b* of the relay case 20. When the relay coil 19 is in the deenergized state, the axial length of the end portion of the movable core 21 disposed inside the cylindrical protrusion 20*b* is greater than the distance (i.e., the gap) between the movable core 21 and the stationary core 23. In other words, even when the relay coil 19 is energized, so that the movable core 21 is attracted fully to the stationary core 23, the movable core 21 does not get out of the inner chamber of the cylindrical protrusion 20*b* completely.

The movable core 21 has formed in central portions of opposed ends thereof cylindrical recesses aligned in the axial direction of the motor relay 2. The movable core 21 is, therefore, of an H-shape in a longitudinal cross section, as can be seen in FIG. 1.

Between the inner bottom surface of the cylindrical protrusion 20*b* of the relay case 20 and the movable core 21, a spacer 34 is disposed which is made of non-magnetic material such as resin or rubber. The spacer 34 has a flat end surface facing the bottom of the cylindrical protrusion 20*b* and a boss formed on the other end thereof. The boss is fit in one of the recesses of the movable core 21.

The bulkhead 22 is greater in thickness than the relay case 20 and forms a magnetic path in a radial direction thereof which is a portion of the magnetic circuit. The bulkhead 22 has a radially outermost edge (i.e., a left edge, as viewed in the drawing) placed in abutment with the inner shoulder of the relay case 20 to secure the position thereof relative to the relay coil 19.

The stationary core 23 and the bulkhead 22 are made of a one-peace member. The stationary core 23 is of a hollow cylinder and extends from the radially central portion of the bulkhead 22 into the bobbin 31 in alignment with the movable core 21. The stationary core 23 and the bulkhead 22 may alternatively be made of separate members which are so joined together mechanically as to form the magnetic path.

An assembly of the stationary core 23 and the bulkhead 22 will also be referred to as a magnetic path component below. The magnetic path component, as can be seen in FIG. 1, has a center hole through which the shaft 35 (which will be described later in detail) passes in the axial direction of the motor relay 2.

The cover 24 is of a bottomed cup-shape with a cylindrical skirt 24*a*. The skirt 24*a* is fit in the opening of the relay case 20 with an end in abutment with the radially outermost edge (i.e., the right edge, as viewed in the drawing) of the bulkhead 22. The thinner wall of the relay case 20 is crimped elastically at an entire circumference or a plurality of discrete circumferential portions thereof to make a firm joint with the skirt 24*a*. A seal 36 such as an O-ring is disposed between the cover 24 and the relay case 20 to hermetical seal therebetween to avoid intrusion of water from outside the motor relay 2.

The external terminal 25 is, as clearly illustrated in FIG. 2, connected electrically to a positive terminal of the battery 6 through a cable. The external terminal 26 is connected electrically to the B-bolt terminal of the electromagnetic switch 5 through a metallic connecting plate or a cable. The external terminals 25 and 26 will also be referred to below as first and second external terminals, respectively.

The first and second external terminals 25 and 26 are, as can be seen in FIG. 1, made of bolts with external threads 25*a* and 26*a*, respectively. The first and second external terminals 25 and 26 also have heads 25*b* and 26*b* formed on ends thereof located remote from the threads 25*a* and 26*a*, respectively. The heads 25*b* and 26*b* are disposed inside the cover 24. The first and second external terminals 25 and 26 have cylindrical bodies extending from inside to outside the cover 24 through holes, so that the external threads 25*a* and 26*a* are located outside the cover 24. Washers 37 and 38 are fastened in engagement with the external threads 25*a* and 26*a* to secure the first and second external terminals 25 and 26 to the cover 24 firmly. Seals 39 and 40 such as an O-ring are disposed in the holes of the cover 24 to hermetically seal between the cover 24 and the first and second external terminals 25 and 26 in order to avoid intrusion of water into the cover 24 through the holes.

The relay contacts are implemented by the first and second fixed contacts 27 and 28 and the movable contact 29. When the movable contact 29 is brought into abutment with the first and second fixed contacts 27 and 28, it will result in electric connection between the first and second fixed contacts 27 and 28, so that the motor relay 2 is closed. Alternatively, when the movable contact 29 is moved away from the first and second fixed contacts 27 and 28, it will block the electric connection between the first and second fixed contacts 27 and 28, so that the motor relay 2 is opened.

The first fixed contact 27 is disposed inside the cover 24 in electric connection with the first external terminal 25 and retained mechanically by the first external terminal 25. Similarly, the second fixed contact 28 is disposed inside the cover 24 in electric connection with the second external terminal 26 and retained mechanically by the second external terminal 26.

Figure 3:
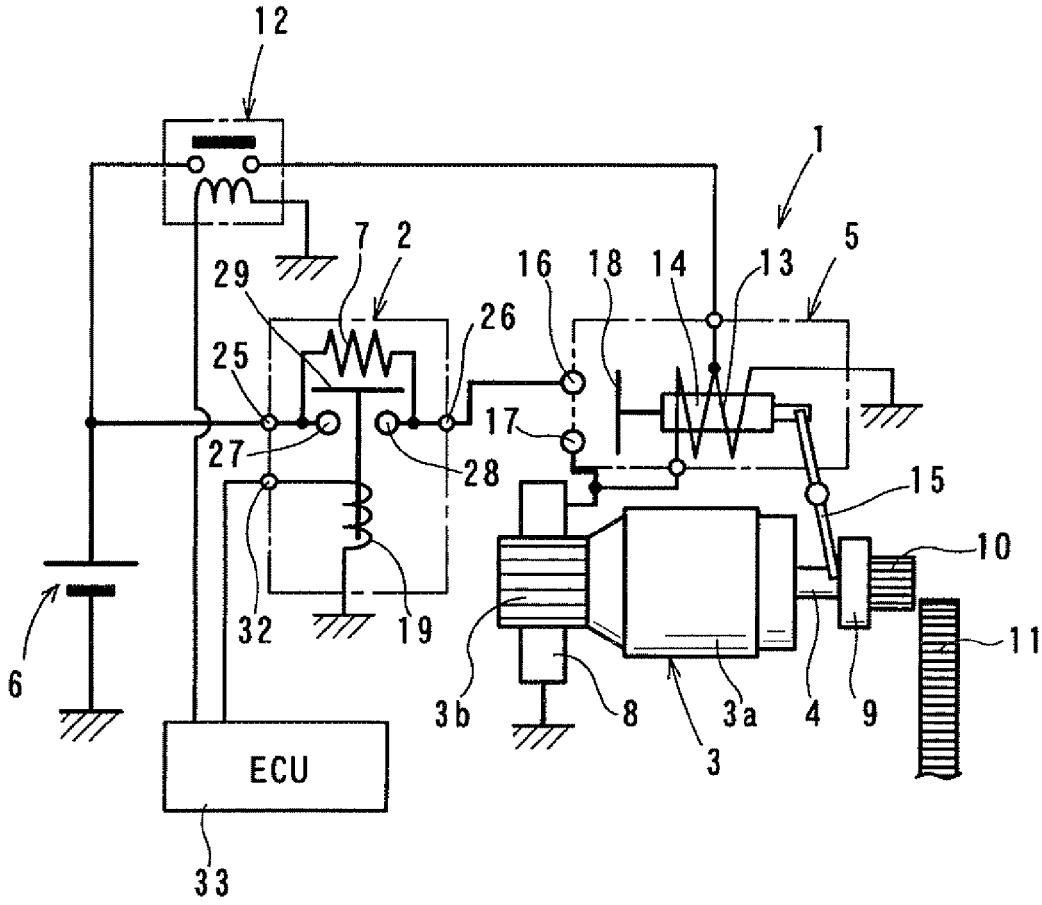
FIG. 3 is a diagram which shows an electric circuit of an automotive engine starter equipped with the electromagnetic relay of FIG. 1 and illustrates for the case where the electromagnetic relay is placed in an on-state.

The movable contact 29 is located remote from the bulkhead 22 on an opposite side of the first and second fixed contacts 27 and 28 within the cover 24. When the relay coil 19 is deenergized, the movable contact 29 is, as illustrated in FIG. 1, urged by the contact spring 41 into constant abutment with the first and second fixed contacts 27 and 28. When the relay coil 19 is energized, the movable core 21 is attracted by the stationary core 23 to push the movable contact 29 through the shaft 35 against the pressure, as produced by the contact spring 41, so that the movable contact 29 is, as illustrated in FIG. 3, disconnected from the first and second fixed contacts 27 and 28. In short, the relay contacts work as a normally-closed switch that is closed when the relay coil 19 is in the deenergized state.

The shaft 35 is made of resin and separate from the movable core 21. The shaft 35 extends in the axial direction of the motor relay 2 through a resinous hollow guide cylinder 42 fit in a through hole formed in the magnetic path component.

The shaft 35 has formed on one of opposed ends thereof a flange 35*a* extending radially of the shaft 35. The flange 35*a* is fit in the recess formed in an end of the movable core 21. The other end (i.e., the right end, as viewed in FIG. 1) of the shaft 35 is located away from the movable contact 29 through an air gap when the relay coil 19 is deenergized. The other end of the shaft 35 may alternatively be placed in light contact with the movable contact 29 unless it results in a decrease in pressure which is produced by the contact spring 41 and exerted on the movable contact 29 and the first and second fixed contacts 27 and 28.

The guide cylinder 42 is formed integrally with the resinous plate 43 disposed in close contact with one of opposed major surfaces of the bulkhead 22 which is farther from the relay coil 19. The guide cylinder 42 is of a hollow cylindrical shape and extends from an inner edge of the resinous plate 43 in a direction perpendicular to the major surface of the resinous plate 43.

The return spring 44 is disposed in a chamber defined by the inner periphery of the though hole formed in the magnetic path component and the outer periphery of the shaft 35. The return spring 44 urges the movable core 21 away from the stationary core 23 at all times. The return spring 44 is retained at one of ends thereof by the flange 35*a* of the shaft 35 and at the other end by the end of the guide cylinder 42, so that the shaft 35 is urged elastically by the return spring 44 into constant abutment with the movable core 21.

The resistor 7 is disposed within a chamber defined remote from the bulkhead 22 on the opposite side (i.e., the right side, as viewed in the drawing) of the resinous plate 43. The resistor 7 is connected at one of ends thereof electrically and mechanically to the head 25*b* of the first external terminal 26 and at the other thereof electrically and mechanically to the head 26*b* of the second external terminal 26.

The resistor 7 is separate from the outer periphery of the shaft 35 and also separate physically from the inner wall of the cover 24 and the surface of the resinous plate 43 in order to minimize thermal damage to the cover 24 and the resinous plate 43 when the resistor 7 glows.

The operation of the starter 1 will be described below with reference to timing charts of FIGS. 4(*a*) to 4(*g*).

Figures 4A, 4B, 4C, 4D, 4E, 4F, 4G:
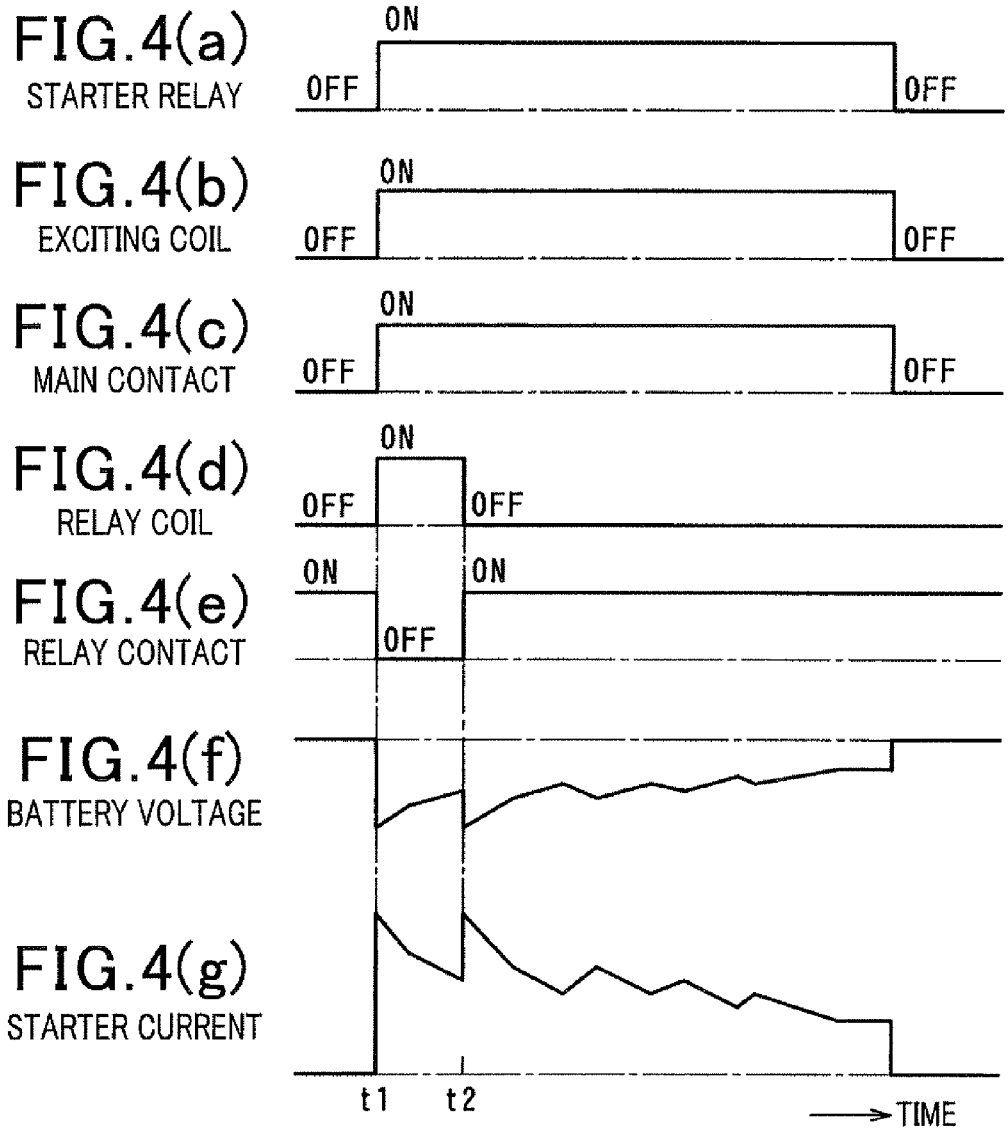
FIGS. 4(*a*) to 4(*g*) are timing charts which demonstrate operations of the engine starter of FIG. 2.

When receiving an input of an engine start request signal at time t1, the ECU 33 outputs, as illustrated in FIGS. 4(*a*) and 4(*d*), motor drive signals (i.e., on-signals) to the starter relay 12 and the motor relay 2. The engine start request signal is to be inputted to the ECU 33 when an ignition switch (not shown) has been turned on by a vehicle operator or the vehicle operator has taken action (e.g., released the brake pedal or shifted a selector lever to a drive range of an automatic transmission of the vehicle) to start the vehicle after the internal combustion engine is stopped in an automatic idle stop mode or during deceleration of the internal combustion engine before stopped in the automatic idle stop mode in the case where the vehicle has installed therein an idle stop system (also called automatic stop/restart system) designed to automatically control stop and restart of the internal combustion engine).

When the starter relay 12 is closed, so that the exciting coil 13 of the electromagnetic switch 5 is energized, as illustrated in FIG. 4(*b*), it will produce magnetic attraction to attract the plunger 14. This causes the pinion 10 and the clutch 9 to be moved together away from the motor 3 by the shift lever 15 along the helical spline on the periphery of the output shaft 4. The end surface of the pinion 10 hits the end surface of the ring gear 11 and then stops. The movement of the plunger 14 also causes, as illustrated in FIG. 4(*c*), the main contacts to be closed at substantially the same time (in practice, with a little lag after) the pinion 10 hits the ring gear 11.

The pinion gear 10 may mesh with the ring gear 11 without hitting the ring gear 11. This is, however, low in probability. The ring gear 10 usually hits the ring gear 11 before meshing with it.

The motor relay 2 is, as illustrated in FIG. 4(*d*), kept on for a given period of time between time t1 and time t2 and then off after time t2. The relay coil 19 is, therefore, energized only between times t1 and t2, so that the relay contacts are, as illustrated in FIG. 4(*e*), kept opened for such an interval When the relay contacts are opened, it will cause, as described above in FIG. 3, the short circuit connecting between the ends of the resistor 7 to be opened, so that the current is supplied from the battery 6 to the motor 3 through the resistor 7. At this time, the voltage which is lower in level than the full voltage of the battery 6 is applied to the motor 3 to control the current flowing through the motor 3. The motor 3, therefore, starts to rotate at a low speed.

After the pinion 10 is rotated by the motor 3 and then meshes with the ring gear 11, the ECU 33 turns off the motor drive signal outputted to the motor relay 2 at time t2, so that the relay contacts are closed, thereby establishing the short circuit connecting between the ends of the resistor 7, so that the current is supplied directly to the motor 3. This causes the full voltage of the battery 6 to be applied to the motor 3, so that the motor 3 rotates at a high speed to transmit torque to the ring gear 11 through the pinion 10 to crank the engine.

The structure of the engine starter 1 has the following advantages.

The motor relay 2 installed in the engine starter 1 is, as described above, of a normally-closed type in which the relay contacts are to be opened when the relay coil 19 is energized. If a vehicle system has failed in operation due to, for example, disconnection or breakage of a motor drive signal line through which the motor drive signal is outputted from the ECU 33 to the motor relay 2 or poor insertion of the motor drive signal line into an electrical connector when the relay contacts are kept opened, that is, the relay coil 19 is kept energized, it will cause the motor drive signal to be cut, so that the relay coil 19 is deenergized, and the relay contacts are closed undesirably.

Specifically, if the motor drive signal is cut when the relay contacts are kept opened, in other words, the current is being supplied to the motor 3 through the resistor 7, the relay contacts will be closed to short-circuit between the ends of the resistor 7, thereby preventing the current from continuing to flow through the resistor 7 even if the motor drive signal to the motor relay 2 is cut off, thus avoiding the melting down of the resistor 7. Further, when the relay contacts are closed, the full voltage of the battery 6 will be supplied to the motor 3, thus ensuring the stability in starting the engine.

The engine starter 1 of this embodiment is, as described above, so designed that the current, as controlled by the resistor 7, is supplied to the motor 3 when started, thus avoiding a short cut of supply of the current to the motor 3 due to a drop in voltage at the terminal of the battery 6. In the case where the vehicle is equipped with the idle stop system, the engine starter 1 of this embodiment ensures the stability in restarting the engine automatically without giving the vehicle operator a discomfort feeling.

The flow of current, as controlled by the resistor 7, through the motor 3 when started results in a decreased speed of rotation of the pinion 10 when meshing with the ring gear 11, thereby alleviating the physical impact on the pinion 10 and the ring gear 11. This results in a decrease in mechanical wear of the pinion 10 and the ring gear 11 and improves the durability thereof. Further, the resistor 7 works to control the starting current to the motor 3, in other words, decrease the inrush current, thus improving the service lift of the main contacts and the brushes of the motor 3.

The motor relay 2 has the resistor 7 which is installed inside the cover 24, in other words, not exposed outside the cover 24, thus avoiding the adhesion of drops of water to the resistor 7 which causes the corrosion thereof and ensuring the durability of the resistor 7. Further, the cover 24 protects the resistor 7 against adhesion of combustible objects existing outside the motor relay 2, thus ensuring the safety of the motor relay 2 when the current continues to flow through resistor 7 for a long time, so that the resistor 7 glows.

The resistor 7 is, as described above, separate from the outer periphery of the shaft 35 and also separate physically from the inner wall of the cover 24 and the surface of the resinous plate 43, thus minimizing the thermal damage to the cover 24 and the resinous plate 43 when the resistor 7 glows. The movable contact 29 is located remote from the bulkhead 22 on the opposite side of the first and second fixed contacts 27 and 28 within the cover 24, thereby keeping the movable contact 29 out of contact with the resistor 7 to ensure the reliability in operation and safety of the motor relay 2.

The relay case 20 of the motor relay 2, as described above, has the bottom wall 20*a* with the hollow protrusion 20*b*. The movable core 21 slides on the inner periphery of the relay coil 19 in the axial direction of the motor relay 2 with the end thereof retained inside the protrusion 20*b*. This structure permits the relay coil 19 to be disposed close to the bottom wall 20*a* of the relay case 20 to use the bottom wall 20*a* as a portion of the magnetic circuit. This eliminates the need for arranging an additional part such as a magnetic plate on the opposite side of the relay coil 19 away from the bulkhead 22, thus minimizing the number of parts and decreasing the number of assembling processes of the motor relay 2.

The length of a portion of the movable core 21 which is disposed inside the hollow protrusion 20*b* is set greater than the interval kept between the movable core 21 and the stationary core 23 when the relay coil 19 is deenergized, in other words, the distance the movable core 21 is to travel when the relay coil 19 is energized. Therefore, even when the relay coil 19 is energized, so that the movable core 21 is attracted by the stationary core 23, the end of the movable core 21 will be kept inside the protrusion 20*b*, in other words, will not get out of the protrusion 20*b*, thus keeping the air gap between the bottom wall 20*a* of the relay case 20 and the movable core 21 to the minimum. Therefore the air gap is kept unchanged from when the movable contact 21 starts to be attracted by the stationary core 23 until it arrives at the stationary core 23, thus keeping the magnetic resistance unchanged for a period of time the movable core 21 travels to the stationary core 23 to ensure a required magnitude of the magnetic attraction, as produced by the stationary core 23.

The bracket 30 is secured to the outer surface of the bottom wall 20*a* of the relay case 20 around the protrusion 20*b*. The thickness of the bracket 30 is set identical with or greater than the height of the protrusion 20*b*. The whole of the protrusion 20*b* is, therefore, kept inside the bracket 30. In other words, the protrusion 20*b* does not project from the thickness of the bracket 30 (i.e., the distance between the ends of the bracket 30 opposed to each other in the axial direction of the motor relay 2), thus improving the mountability of the motor relay 2 in the engine starter 1. When the relay case 20 is formed by the drawing process, it usually has a decreased thickness. The bracket 30 which is made of a thick plate and attached to the bottom wall 20*a* of the relay case 20 is, however, used as a portion of the magnetic circuit, thus alleviating an increase in magnetic resistance of the bottom wall 20*a* of the relay case 20 which is made to have a small thickness.

The motor relay 2 has the resinous thin-wall hollow cylinder 31*a* installed between the outer periphery of a portion of the movable core 21 located inside the protrusion 20*b* of the relay case 20 and the inner periphery of the protrusion 20*b*, thereby avoiding the metal-to-metal rubbing of the outer periphery of the movable core 21 on the inner periphery of the protrusion 20*b* when the movable core 21 is moved in the axial direction of the motor relay 2 to minimize the mechanical wear of the movable core 21 and the protrusion 20*b*.

The thin-wall hollow cylinder 31*a* is, as described above, formed integrally with the bobbin 31 of the relay coil 19 to have an inner cylindrical even surface which extends over the inner periphery of the bobbin 21 without any irregularities, thus ensuring the smooth movement of the movable core 21 in the axial direction thereof without the axis thereof being inclined greatly.

The motor relay 2 has the non-magnetic material made spacer 34 disposed between the bottom wall 20*a* of the relay case 20 and the movable core 21 to keep the end of the movable core 21 away from the bottom wall 20*a*, thereby resulting in an increase in magnetic resistance therebetween. This avoids the attraction of the movable core 21 to the bottom wall 20*a* of the relay case 20 when the relay coil 19 is energized, thus ensuring a required magnitude of magnetic attraction between the stationary core 23 and the movable core 21.

The spacer 34 is made of an elastically deformable material such as rubber or resin, thus absorbing impact sound arising from hitting of the movable contact 21 against the spacer 34 when the motor drive signal, as outputted from the ECU 33 to the motor relay 2, is switched from the on-state to the off-state, so that the relay coil 19 is deenergized, and the movable core 21 is returned away from the stationary core 23.

The motor relay 2 has the guide cylinder 42 fit in the inner periphery of the hole extending through the center of the magnetic path component made up of the bulkhead 22 and the stationary core 23 and also has the resinous shaft 35 extending through the center hole of the guide cylinder 42. When the movable core 21 is attracted magnetically in the axial direction thereof, the shaft 35 slides on the inner periphery of the guide cylinder 42. The guide cylinder 42 is, as described above, made of the elastic material, thus minimizing the mechanical wear of the shaft 35 arising from the sliding on the guide cylinder 42.

The resinous shaft 35 has the flange 35*a* which is formed on the end thereof closing to the movable core 21 and bears the spring pressure, as produced by the return spring 44. The spring pressure urges the shaft 35 into abutment with the movable core 21, thus eliminating the need for securing the shaft 35 mechanically to the movable core 21 using, for example, a swaging tool, which minimizes production processes for the motor relay 2.

The movable core 21 is, as can be seen from FIG. 1, of an H-shape in a longitudinal cross section extending through the radial center thereof to have the cylindrical recesses formed in the opposed ends thereof, thus resulting in a decrease in weight of the movable core 21, which ensures a quick movement thereof in response to the attraction to the stationary core 23. The cylindrical recesses are symmetrical in shape, thus permitting the movable core 21 to be inserted into the bobbin 31 from either end thereof, which leads to a decrease in error in assembling the motor relay 2.

The flange 35*a* of the shaft 35 is fit in one of the cylindrical recesses of the movable core 21, thus eliminating the possibility of misalignment of the flange 35*a* (i.e., the shaft 35) with the movable core 21 in the radial direction thereof.

The first and second external terminals 25 and 26 are made of bolts with the external threads 25*a* and 26*a*. The first and second external terminals 25 and 26 have the cylindrical bodies extending from inside to outside the cover 24, so that the external threads 25*a* and 26*a* are located outside the cover 24. The electric leads are, as illustrated in FIG. 1, joined to the external threads 25*a* and 26*a*. The first and second external terminals 25 and 26 have configurations like in typical electromagnetic switches for use in conventional engine starters, thus enabling the motor relay 2 to be connected electrically to electric parts of the starter 1 and the vehicle (i.e., the battery 6 and the electromagnetic switch 5) without having to exchange electric leads or connectors typically used in the vehicle.

Figure 5:
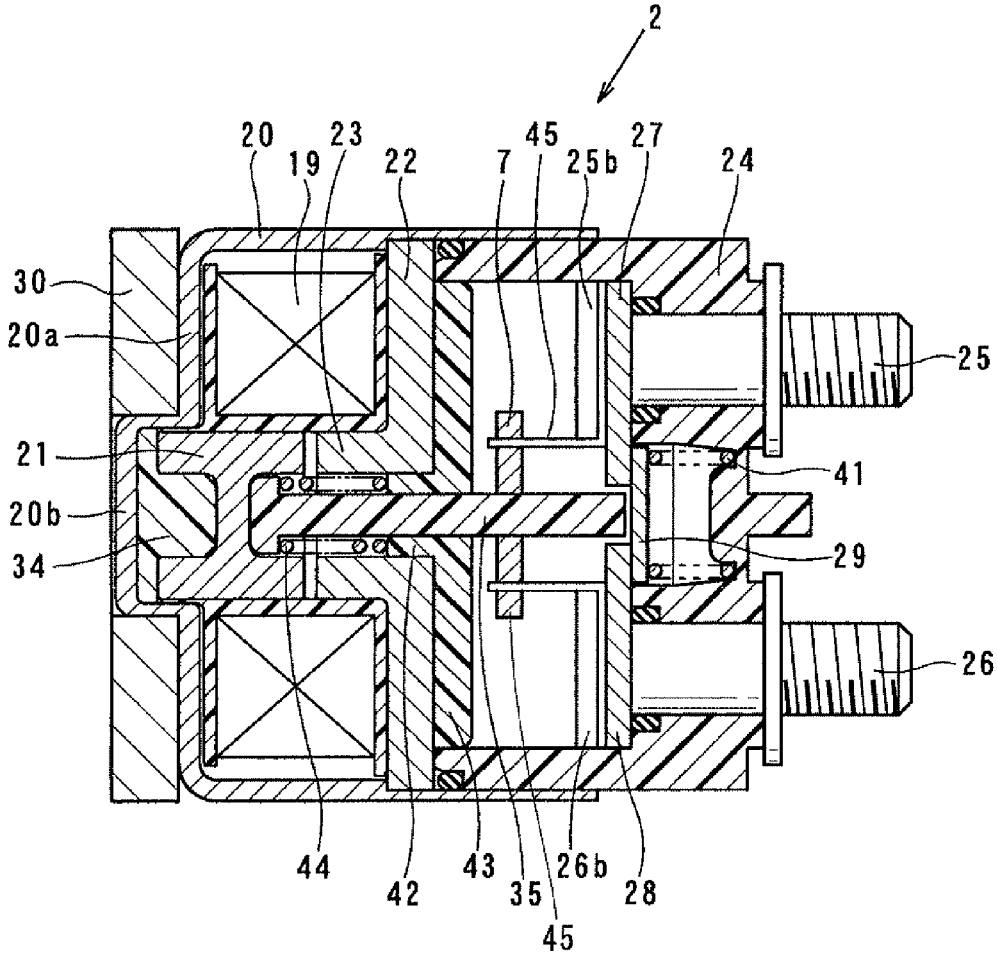
FIG. 5 is a longitudinal sectional view which shows an internal structure of an electromagnetic relay according to the second embodiment of the invention.

FIG. 5 illustrates the motor relay 2 according to the second embodiment of the invention. The same reference numbers, as employed in the first embodiment, refer to the same parts, and explanation thereof in detail will be omitted here.

The motor relay 2 of this embodiment is different from the one in the first embodiment in electric connection of the resistor 7 to the first and second external terminals 25 and 26. Other arrangements are identical with those in the first embodiment.

Specifically, the resistor 7 is connected at one of ends thereof to the first external terminal 25 indirectly through a first connecting member 45 and at the other end thereof to the second external terminal 26 indirectly through a second connecting member 45. Each of the first and second connecting members 45 is made of a good conductive material such as aluminum, copper, or iron.

Each of the first and second connecting members 45 is implemented by an L-shaped metallic plate. The first connecting member 45 is nipped at a vertically extending one of ends thereof between the head 25*b* of the first external terminal 25 and the first fixed contact 27. Similarly, the second connecting member 45 is nipped at a vertically extending one of ends thereof between the head 26*b* of the second external terminal 26 and the first fixed contact 28. The other ends of the first and second connecting members 45 extend horizontally in the axial direction of the motor relay 2 and connect with the resistor 7.

Each of the first and second connecting members 45 may alternatively be made of a flexible wire. It is necessary, in this case, to use an additional support such as a stay to retain the resistor 7 firmly.

Figure 6:
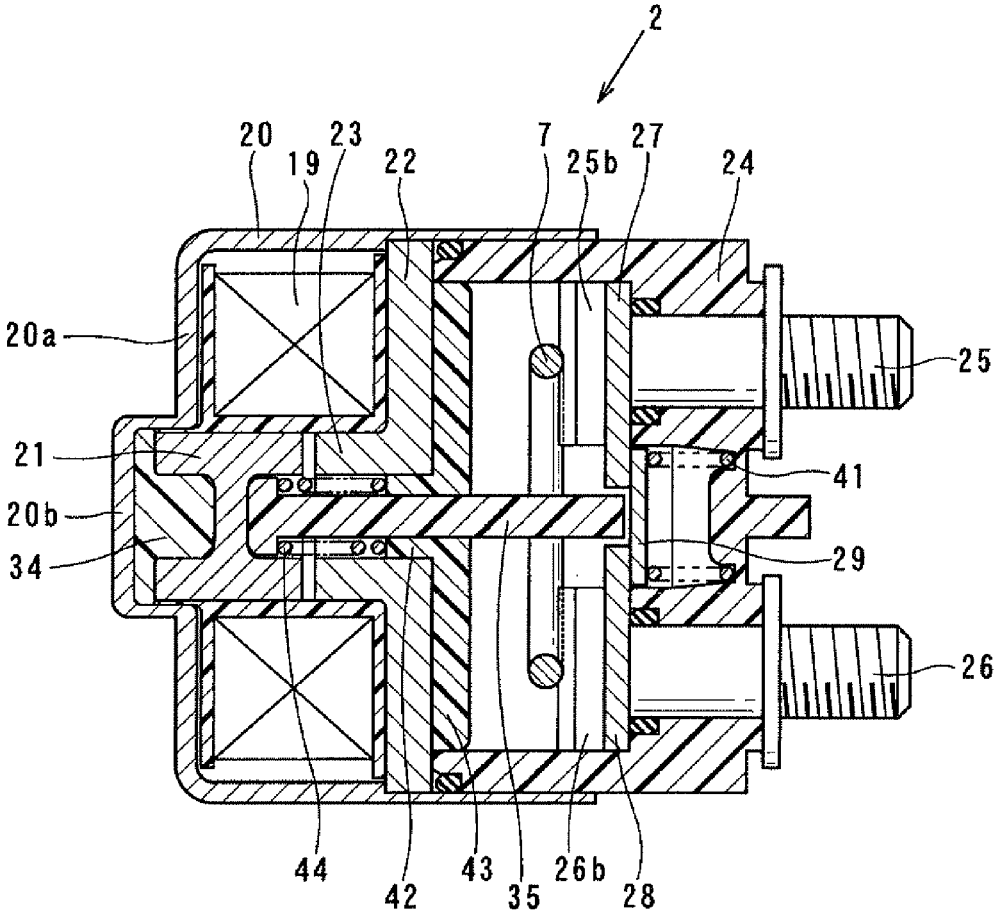
FIG. 6 is a longitudinal sectional view which shows an internal structure of an electromagnetic relay according to the third embodiment of the invention.

FIG. 6 illustrates the motor relay 2 according to the third embodiment of the invention. The same reference numbers, as employed in the first embodiment, refer to the same parts, and explanation thereof in detail will be omitted here.

The motor relay 2 of this embodiment does not have the bracket 30 used in the first embodiment.

A metallic band (not shown) may be wrapped around the periphery of the relay case 20 tightly to installation of the motor relay 2 in the vehicle. The motor relay 2 may alternatively be mounted within a box-like space provided in an engine compartment of the vehicle.

The resistor 7 is, like in the first embodiment, connected mechanically or welded at one of the ends thereof to the head 25*b* of the first external terminal 25 and at the other end thereof to the head 26*b* of the second external terminal 26, but may alternatively be joined electrically to the first and second external terminals 25 and 26 through the connecting members 45, as used in the second embodiment of FIG. 5.

Figure 7A:
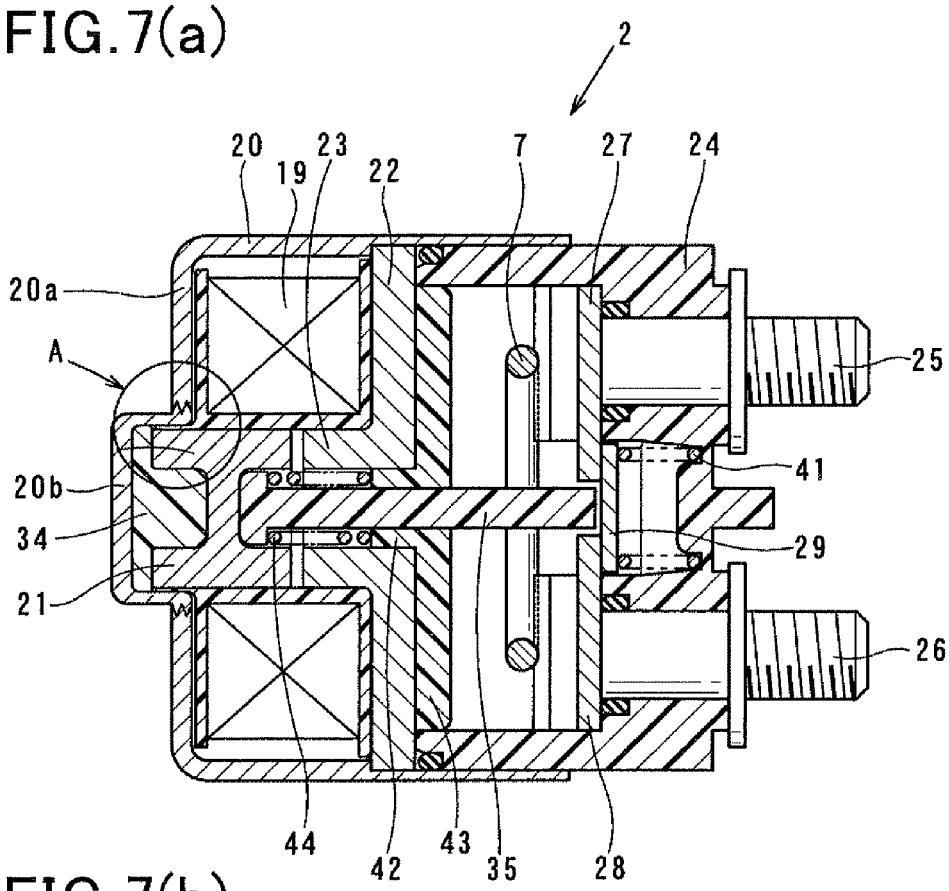
FIG. 7(*a*) is a longitudinal sectional view which shows an internal structure of an electromagnetic relay according to the fourth embodiment of the invention.
Figure 7B:
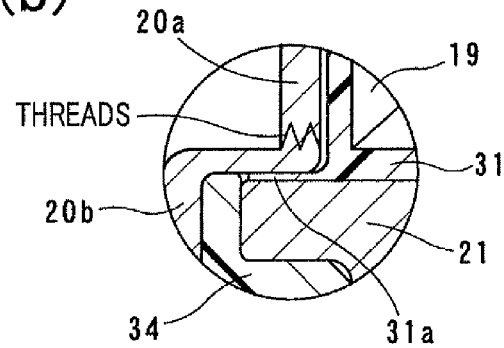

FIGS. 7(*a*) and 7(*b*) illustrate the motor relay 2 according to the fourth embodiment of the invention. The same reference numbers, as employed in the first embodiment, refer to the same parts, and explanation thereof in detail will be omitted here.

The relay case 20 is made up of two separate parts: one of a main body with the bottom wall 20*a* and the other is a cup (i.e., the protrusion 20*b*). The cup is joined detachably to the bottom wall 20*a* through threads. Specifically, the cup has, as clearly illustrated in FIG. 7(*b*), has an external thread, while the bottom wall 20*a* has an internal thread.

The structure of this embodiment enables the cup (i.e., the protrusion 20*b*) to be installed to or deinstalled from the bottom wall 20*a* of the relay case 20. The removal of the movable core 21, the shaft 35, the return spring 44, etc. outside the relay case 20 is achieved by unfastening the protrusion 20*b* to open the bottom wall 20*b*.

Since the shaft 35 of the motor relay 20 is, as described above, made of resin, the end of the shaft 35 will be worn by hitting the metallic movable contact 29 many times, which may result in a failure in pushing the movable contact 29 away from the first and second fixed contacts 27 and 28, that is, opening the relay contacts of the motor relay 2 when the relay coil 19 is energized. In the event of such a problem, the worn shaft 35 may be taken out of the relay case 20 for replacement thereof by removing the protrusion 20*b* from the bottom wall 20*a* of the relay case 20. After the new shaft 35 is installed in the relay case 20, the protrusion 20*b* is fastened to the bottom wall 20*a* of the relay case 20.

Figure 8A:
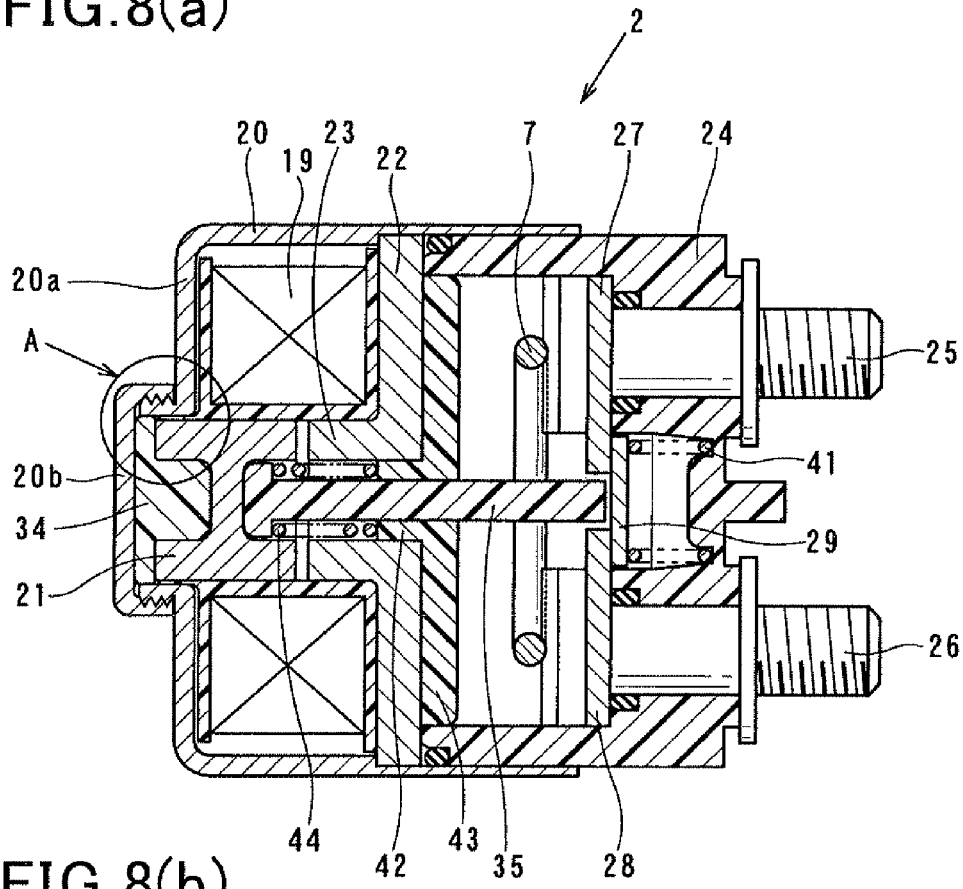
FIG. 8(*a*) is a longitudinal sectional view which shows a modification of the electromagnetic relay, as illustrated in FIGS. 7(*a*) and 7(*b*)
Figure 8B:
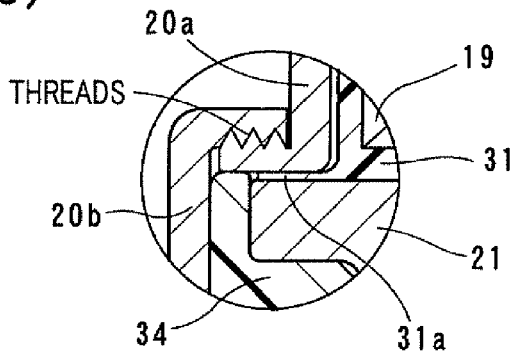

FIGS. 8(*a*) and 8(*b*) illustrate a modification of the relay case 20 in the fourth embodiment.

The protrusion 20*b* of the relay case 20 is, like in the fourth embodiment of FIGS. 7(*a*) and 7(*b*), designed to be installed to or deinstalled from the bottom wall 20*a* easily. Specifically, the protrusion 20*b* has, as clearly illustrated in FIG. 8(*b*), has an internal thread, while the bottom wall 20*a* has an external thread. Other arrangements are identical with those in the fourth embodiment, and explanation thereof in detail will be omitted here.

The protrusion 20*b* and the bottom wall 20*a* of the relay case 20 in FIGS. 7(*a*) to 8(*b*) may alternatively be machined to have engaging portions, respectively, for installing the protrusion 20*b* firmly in the opening of the bottom wall 20*a*. For instance, the protrusion 20*b* may be press-fitted in the opening of the bottom wall 20*a*. The fitting may be achieved by turning the protrusion 20*b* in a radial direction thereof and inserting it into the opening of the bottom wall 20*a*.

Figure 9:
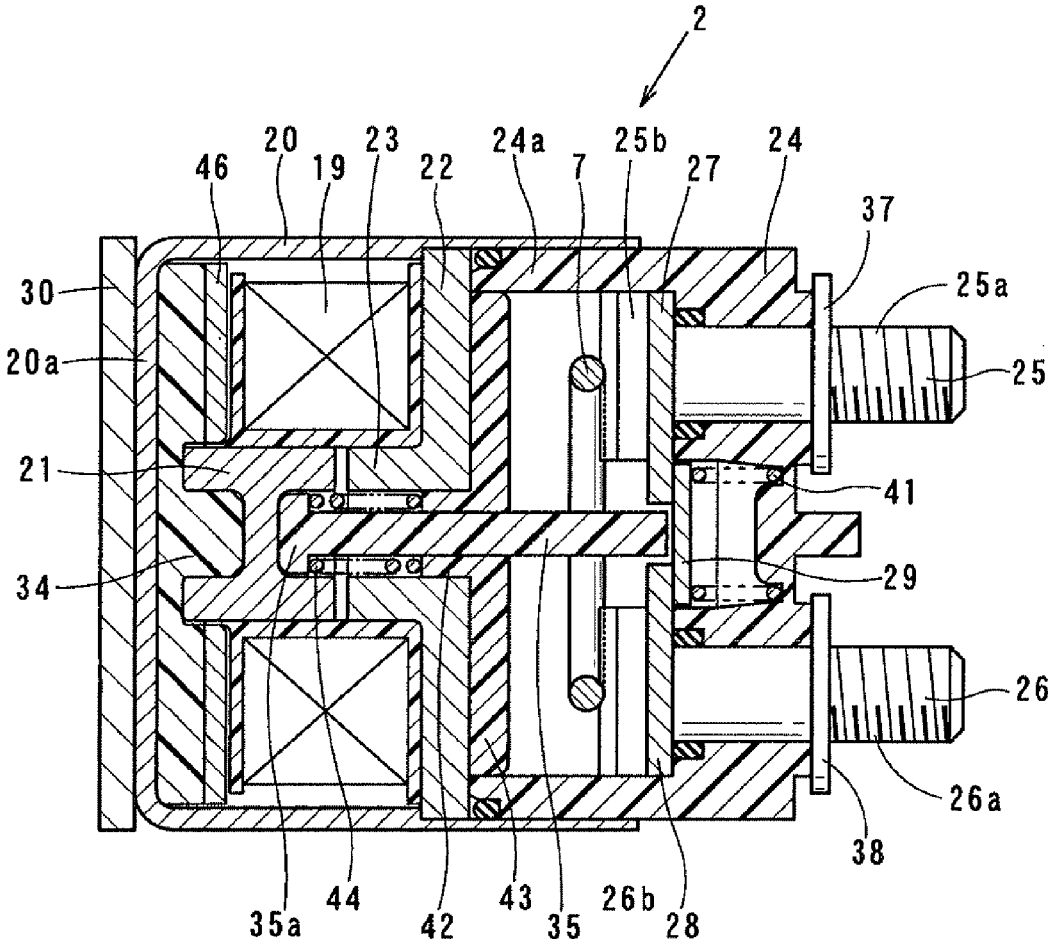
FIG. 9 is a longitudinal sectional view which shows an internal structure of an electromagnetic relay according to the fifth embodiment of the invention.

FIG. 9 illustrates the motor relay 2 according to the fifth embodiment of the invention. The same reference numbers, as employed in the first embodiment, refer to the same parts, and explanation thereof in detail will be omitted here.

The motor relay 2 is, like in the first embodiment of a normally closed type. The relay case 20 has, as can be seen from the drawing, the flat bottom wall 20*a* extending substantially perpendicular to the longitudinal center line of the relay case 20. In other words, the relay case 20 does not have the protrusion 20*b* in the first embodiment.

The motor relay 2 also has a magnetic plate 46 disposed remote from the bulkhead 22 on the opposite side of the relay coil 19. The magnetic plate 46 has substantially the same thickness as that of the relay case 20 and is of an annular shape with a radial center hole. The magnetic plate 46 works as a portion of the magnetic circuit (i.e., a magnetic path) which extends radially between the relay case 20 and the movable core 21. The inner diameter of the center hole of the magnetic plate 46 is set to be slightly greater than the outer diameter of the movable core 21 so as to permit the movable core 21 to move therethrough in the axial direction of the movable core 21.

The motor relay 2 also includes a spacer 34 made of a non-magnetic material such as resin or rubber. The spacer 34 is disposed among the bottom wall 20*a* of the relay case 20, the movable core 21, and the magnetic plate 46. The spacer 34 may alternatively be placed only between the bottom wall 20*a* of the relay case 20 and the movable core 21. For instance, the spacer 34 may be machined to have an outer diameter smaller than illustrated in FIG. 9 so as to expose the magnetic plate 46 to the inner surface of the bottom wall 20*a* through an air gap. In this case, the magnetic plate 46 may have an increased thickness so as to be placed in direct abutment with the bottom wall 20*a* of the relay case 20 as long as the movable core 21 slides properly.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

In typical normally-closed electromagnetic relays, planes of the movable contact and the fixed contacts may rub on each other when subjected to external mechanical vibrations, which leads to a change in resistance of contact between the planes or chattering of the planes. In order to avoid this problem, contact surfaces of the first and second fixed contacts 27 and 28 and the movable contact 29 may have small irregularities.

The relay case 20 in each of the above embodiments is shaped to have a circular transverse cross section, but may alternatively be formed to have a polygonal cross section such as a square or hexagonal.

The motor relay 2 of the first embodiment is, as can be seen from FIG. 2, disposed electrically upstream of the main contacts of the electromagnetic switch 5, but may alternatively be placed electrically downstream of the main contacts between the M-terminal and the motor 3.

The bobbin 31 of the relay coil 19 in the first embodiment is separate from the assembly of the resinous plate 43 and the guide cylinder 42, but may alternatively be formed integrally therewith by a one-piece member. For instance, the bulkhead 22 and the stationary core 23 may be insert-molded among the bobbin 31, the resinous plate 43, and the guide cylinder 42.

What is claimed is:

1. A normally-closed electromagnetic relay comprising:

a hollow case which has an end extending substantially perpendicular to an axial direction thereof to define a bottom, the bottom having a radially central portion extending outwardly of the hollow case in the axial direction to define a hollow protrusion;

a resistor to be connected electrically at ends thereof to a motor circuit to control a starting current supplied from a battery to an electric motor when it is required to start the electric motor;

a relay coil disposed inside the hollow case, the relay coil producing magnetic attraction when energized;

a movable core having a first and a second end opposed to each other in an axial direction thereof in which the movable core is to be moved by the magnetic attraction, as produced by the relay coil, along an inner periphery of the relay coil with the first end being disposed inside the hollow protrusion of the case;

relay contacts which are to be opened or closed selectively by movement of the movable core when the relay coil is energized or deenergized; and a short circuit which is created by closing of the relay contacts when the relay coil is deenergized to establish an electric connection between the ends of the resistor to supply an electric current from the battery to the electric motor without flowing through the resistor and opened by opening of the relay contacts when the relay coil is energized to supply the electric current from the battery to the electric motor through the resistor.

2. A normally-closed electromagnetic relay as set forth in claim 1, further comprising a stationary core disposed adjacent the second end of the movable core, the stationary core being magnetized when the relay coil is energized to produce the magnetic attraction to attract the movable core, and wherein a length of a portion of the movable core which is disposed inside the hollow protrusion is set greater than an interval kept between the movable core and the stationary core when the relay coil is deenergized.

3. A normally-closed electromagnetic relay as set forth in claim 1, further comprising a hollow resinous bobbin around of which the relay coil is wound and a thin-wall hollow cylinder formed integrally with the bobbin, and wherein the thin-wall hollow cylinder is disposed between a portion of an outer periphery of the movable core disposed inside the hollow protrusion and an inner periphery of the hollow protrusion, the thin-wall hollow cylinder having substantially the same inner diameter as the hollow protrusion to have a common cylindrical inner wall extending without any irregularities to define the outer periphery of the movable core and the inner periphery of the hollow protrusion.

4. A normally-closed electromagnetic relay as set forth in claim 1, wherein the hollow case has a main body with a bottom which is formed to be separate from the hollow protrusion, and wherein the hollow protrusion is joined detachably to the bottom of the main body of the hollow case.

5. A normally-closed electromagnetic relay as set forth in claim 1, further comprising a non-magnetic spacer disposed between an inner bottom surface of the hollow protrusion and the movable core.

6. A normally-closed electromagnetic relay as set forth in claim 1, further comprising a bracket for use in mounting the electromagnetic relay in a vehicle, the bracket being disposed outside the hollow protrusion and fixed on the bottom of the hollow case, and wherein the bracket has a thickness in an axial direction of the electromagnetic relay, the thickness being substantially identical with or greater than a height of the hollow protrusion which projects from a major body of the relay case.

7. A normally-closed electromagnetic relay as set forth in claim 2, further comprising (a) a bulkhead which is located remote from the bottom of the relay case on an opposite side of the relay coil and formed one of integrally with and separately from the stationary core, (b) an insulating cover which closes an opening formed in an end of the hollow case which is opposite the bottom and is secured to the hollow case, (c) a first external terminal which is secured to the insulating cover and connected to a high-potential side of the motor circuit, (d) a second external terminal which is secured to the insulating cover and connected to a low-potential side of the motor circuit, (e) a first fixed contact which is disposed inside the insulating cover and connected electrically and mechanically to the first external terminal, (f) a second fixed contact which is disposed inside the insulating cover and connected electrically and mechanically to the second external terminal, (g) a movable contact which is disposed remote from the bulkhead on an opposite side of the first and second fixed contacts and to be moved following movement of the movable core to establish and block an electric connection between the first and second fixed contacts, selectively, and (h) a shaft which, when the relay coil is energized to move the movable core to the stationary core, transmit movement of the movable core to the movable contact, and wherein the resistor is disposed inside the insulating cover and connected at one of the ends thereof to the first external terminal and at the other end to the second external terminal, and wherein when the relay coil is energized, the movable contact is moved away from the first and second fixed contacts to open the relay contacts, while when the relay coil is deenergized, the movable contact is moved into abutment with the first and second fixed contacts to close the relay contacts.

8. A normally-closed electromagnetic relay as set forth in claim 5, wherein the spacer has elasticity.

9. A normally-closed electromagnetic relay as set forth in claim 7, wherein surfaces of the first and second fixed contacts and the movable contact which are to be placed in contact with each other have irregularities.

10. A normally-closed electromagnetic relay as set forth in claim 7, wherein the bulkhead and the stationary core constitute a magnetic path component which has formed in a radially central portion thereof a hole which extends in an axial direction of the magnetic path component and through which a resinous hollow guide cylinder is disposed, and wherein the shaft is made of an insulating material separate from the movable core and to be moved inside the hollow guide cylinder following the movement of the movable core.

11. A normally-closed electromagnetic relay as set forth in claim 8, further comprising a return spring which works to urge the movable core away from the stationary core, and wherein the shaft has formed on an end thereof facing the movable core a flange which extends radially outwardly of the shaft, the flange being exerted by pressure, as produced by the return spring, to be brought into constant abutment with the movable core.

12. A normally-closed electromagnetic relay as set forth in claim 7, wherein each of the first and second external terminals is provided by a bolt with an external thread and secured to the cover with the external thread being exposed outside the cover.

13. A normally-closed electromagnetic relay as set forth in claim 1, wherein the movable core has recesses formed in radially central portions of ends opposed to each other in an axial direction thereof to have an H-shape in longitudinal cross section extending in the axial direction of the movable core.

14. A normally-closed electromagnetic relay comprising:

a hollow case which has ends opposed to each other in an axial direction of the hollow case, one of the ends defining a bottom, the other end having an opening;

a resistor to be connected electrically at ends thereof to a motor circuit to control a starting current supplied from a battery to an electric motor when it is required to start the electric motor;

a relay coil disposed inside the hollow case, the relay coil producing magnetic attraction when energized;

a movable core which is to be moved by the magnetic attraction, as produced by the relay coil, along an inner periphery of the relay coil;

relay contacts which are to be opened or closed selectively by movement of the movable core when the relay coil is energized or deenergized;

a short circuit which is created by closing of the relay contacts when the relay coil is deenergized to establish an electric connection between the ends of the resistor to supply an electric current from the battery to the electric motor without flowing through the resistor and opened by opening of the relay contacts when the relay coil is energized to supply the electric current from the battery to the electric motor through the resistor;

an annular magnetic plate disposed between the bottom of the relay case and an end of the relay coil to create a magnetic path between the hollow case and the movable core;

a bulkhead which is located remote from the magnetic plate on an opposite side of the relay coil to create a magnetic path extending radially thereof;

a stationary core which is formed one of integrally with and separately from the bulkhead and develops a magnetic path continuing to the magnetic path, as created by the bulkhead, the stationary core being so disposed as to face the movable core in an axial direction thereof;

an insulating cover which closes the opening of the hollow case and is secured to the hollow case;

a first external terminal which is secured to the insulating cover and connected to a high-potential side of the motor circuit;

a second external terminal which is secured to the insulating cover and connected to a low-potential side of the motor circuit;

a first fixed contact which is disposed inside the insulating cover and connected electrically and mechanically to the first external terminal;

a second fixed contact which is disposed inside the insulating cover and connected electrically and mechanically to the second external terminal;

a movable contact which is disposed remote from the bulkhead on an opposite side of the first and second fixed contacts and to be moved following movement of the movable core to establish and block an electric connection between the first and second fixed contacts, selectively; and a shaft which, when the relay coil is energized to move the movable core to the stationary core, transmit movement of the movable core to the movable contact, and wherein the resistor is disposed inside the insulating cover and connected at one of the ends thereof to the first external terminal and at the other end to the second external terminal, and wherein when the relay coil is energized, the movable contact is moved away from the first and second fixed contacts to open the relay contacts, while when the relay coil is deenergized, the movable contact is moved into abutment with the first and second fixed contacts to close the relay contacts.

15. A normally-closed electromagnetic relay as set forth in claim 14, further comprising a non-magnetic spacer disposed between the bottom of the hollow case and the movable core.

16. A normally-closed electromagnetic relay as set forth in claim 15, wherein the spacer has elasticity.

17. A normally-closed electromagnetic relay as set forth in claim 14, wherein surfaces of the first and second fixed contacts and the movable contact which are to be placed in contact with each other have irregularities.

18. A normally-closed electromagnetic relay as set forth in claim 14, wherein the bulkhead and the stationary core constitute a magnetic path component which has formed in a radially central portion thereof a hole which extends in an axial direction of the magnetic path component and through which a resinous hollow guide cylinder is disposed, and wherein the shaft is made of an insulating material separate from the movable core and to be moved inside the hollow guide cylinder following the movement of the movable core.

19. A normally-closed electromagnetic relay as set forth in claim 16, further comprising a return spring which works to urge the movable core away from the stationary core, and wherein the shaft has formed on an end thereof facing the movable core a flange which extends radially outwardly of the shaft, the flange being exerted by pressure, as produced by the return spring, to be brought into constant abutment with the movable core.

20. A normally-closed electromagnetic relay as set forth in claim 14, wherein each of the first and second external terminals is provided by a bolt with an external thread and secured to the cover with the external thread being exposed outside the cover.

21. A normally-closed electromagnetic relay as set forth in claim 14, wherein the movable core has recesses formed in radially central portions of ends opposed to each other in an axial direction thereof to have an H-shape in longitudinal cross section extending in the axial direction of the movable core.

* * * * *